US008754581B2

(12) United States Patent
Jin et al.

(10) Patent No.: US 8,754,581 B2
(45) **Date of Patent: *Jun. 17, 2014**

(54) HIGH EFFICIENCY LED DRIVING METHOD FOR ODD NUMBER OF LED STRINGS

(71) Applicant: Microsemi Corporarion, Aliso Viejo, CA (US)

(72) Inventors: Xiaoping Jin, Orange, CA (US); Ting-Hui Lin, Taipei (TW)

(73) Assignee: Microsemi Corporation, Aliso Viejo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/717,755

(22) Filed: Dec. 18, 2012

(65) Prior Publication Data

US 2013/0106299 A1 May 2, 2013

Related U.S. Application Data

(63) Continuation-in-part of application No. 13/461,793, filed on May 2, 2012, now Pat. No. 8,598,795.

(60) Provisional application No. 61/482,116, filed on May 3, 2011.

(51) Int. Cl.

| | |
|---|---|
| ***H05B 37/00*** | (2006.01) |
| ***H05B 39/00*** | (2006.01) |
| ***H05B 41/00*** | (2006.01) |

(52) U.S. Cl.

USPC ..... 315/186; 315/192; 315/210; 315/220

(58) Field of Classification Search

None

See application file for complete search history.

(56) References Cited

U.S. PATENT DOCUMENTS

| | | | |
|---|---|---|---|
| 2,429,162 | A | 10/1947 | Keiser et al. |
| 2,440,984 | A | 5/1948 | Summers |
| 2,572,258 | A | 10/1951 | Goldfield et al. |
| 2,965,799 | A | 12/1960 | Brooks et al. |
| 2,968,028 | A | 1/1961 | Goto et al. |
| 3,141,112 | A | 7/1964 | Eppert |
| 3,565,806 | A | 2/1971 | Ross |
| 3,597,656 | A | 8/1971 | Douglas |
| 3,611,021 | A | 10/1971 | Wallace |

(Continued)

FOREIGN PATENT DOCUMENTS

| | | |
|---|---|---|
| EP | 0326114 | 8/1989 |
| EP | 0587923 | 3/1994 |

(Continued)

OTHER PUBLICATIONS

Williams, B.W.; "Power Electronics Devices, Drivers, Applications and Passive Components"; Second Edition, McGraw-Hill, 1992; Chapter 10, pp. 218-249.

(Continued)

*Primary Examiner* — Anh Tran
(74) *Attorney, Agent, or Firm* — Simon Kahn

(57) ABSTRACT

An arrangement wherein a plurality of LED strings are driven with a balanced drive signal, i.e. a drive signal wherein the positive side and negative side are of equal energy over time, is provided. In a preferred embodiment, the drive signal is balanced responsive to a capacitor provided between a switching network and a driving transformer. Balance of current between various LED strings is provided by a balancing transformer.

12 Claims, 7 Drawing Sheets

(56) References Cited

U.S. PATENT DOCUMENTS

| | | | |
|---|---|---|---|
| 3,683,923 | A | 8/1972 | Anderson |
| 3,737,755 | A | 6/1973 | Calkin et al. |
| 3,742,330 | A | 6/1973 | Hodges et al. |
| 3,936,696 | A | 2/1976 | Gray |
| 3,944,888 | A | 3/1976 | Clark |
| 4,060,751 | A | 11/1977 | Anderson |
| 4,353,009 | A | 10/1982 | Knoll |
| 4,388,562 | A | 6/1983 | Josephson |
| 4,441,054 | A | 4/1984 | Bay |
| 4,463,287 | A | 7/1984 | Pitel |
| 4,523,130 | A | 6/1985 | Pitel |
| 4,562,338 | A | 12/1985 | Okami |
| 4,567,379 | A | 1/1986 | Corey et al. |
| 4,572,992 | A | 2/1986 | Masaki |
| 4,574,222 | A | 3/1986 | Anderson |
| 4,622,496 | A | 11/1986 | Dattilo et al. |
| 4,630,005 | A | 12/1986 | Clegg et al. |
| 4,663,566 | A | 5/1987 | Nagano |
| 4,663,570 | A | 5/1987 | Luchaco et al. |
| 4,672,300 | A | 6/1987 | Harper |
| 4,675,574 | A | 6/1987 | Delflache |
| 4,686,615 | A | 8/1987 | Ferguson |
| 4,698,554 | A | 10/1987 | Stupp et al. |
| 4,700,113 | A | 10/1987 | Stupp et al. |
| 4,761,722 | A | 8/1988 | Pruitt |
| 4,766,353 | A | 8/1988 | Burgess |
| 4,780,696 | A | 10/1988 | Jirka |
| 4,847,745 | A | 7/1989 | Shekhawat et al. |
| 4,862,059 | A | 8/1989 | Tominaga et al. |
| 4,893,069 | A | 1/1990 | Harada et al. |
| 4,902,942 | A | 2/1990 | El-Hamamsy |
| 4,939,381 | A | 7/1990 | Shibata et al. |
| 5,023,519 | A | 6/1991 | Jensen |
| 5,030,887 | A | 7/1991 | Guisinger |
| 5,036,255 | A | 7/1991 | McKnight et al. |
| 5,057,808 | A | 10/1991 | Dhyanchand |
| 5,173,643 | A | 12/1992 | Sullivan et al. |
| 5,349,272 | A | 9/1994 | Rector |
| 5,434,477 | A | 7/1995 | Crouse et al. |
| 5,475,284 | A | 12/1995 | Lester et al. |
| 5,485,057 | A | 1/1996 | Smallwood et al. |
| 5,519,289 | A | 5/1996 | Katyl et al. |
| 5,539,281 | A | 7/1996 | Shackle et al. |
| 5,557,249 | A | 9/1996 | Reynal |
| 5,563,473 | A | 10/1996 | Mattas et al. |
| 5,574,335 | A | 11/1996 | Sun |
| 5,574,356 | A | 11/1996 | Parker |
| 5,615,093 | A | 3/1997 | Nalbant |
| 5,619,402 | A | 4/1997 | Lin |
| 5,621,281 | A | 4/1997 | Kawabata et al. |
| 5,652,479 | A | 7/1997 | LoCascio et al. |
| 5,712,776 | A | 1/1998 | Palara et al. |
| 5,754,012 | A | 5/1998 | LoCascio et al. |
| 5,818,172 | A | 10/1998 | Lee |
| 5,822,201 | A | 10/1998 | Kijima |
| 5,825,133 | A | 10/1998 | Conway |
| 5,828,156 | A | 10/1998 | Roberts |
| 5,854,617 | A | 12/1998 | Lee et al. |
| 5,892,336 | A | 4/1999 | Lin et al. |
| 5,910,713 | A | 6/1999 | Nishi et al. |
| 5,912,812 | A | 6/1999 | Moriarty, Jr. |
| 5,914,842 | A | 6/1999 | Sievers |
| 5,923,129 | A | 7/1999 | Henry |
| 5,930,121 | A | 7/1999 | Henry |
| 5,930,126 | A | 7/1999 | Griffin et al. |
| 5,936,360 | A | 8/1999 | Kaneko |
| 6,002,210 | A | 12/1999 | Nilssen |
| 6,020,688 | A | 2/2000 | Moisin |
| 6,028,400 | A | 2/2000 | Pol et al. |
| 6,037,720 | A | 3/2000 | Wong et al. |
| 6,038,149 | A | 3/2000 | Hiraoka et al. |
| 6,040,662 | A | 3/2000 | Asayama |
| 6,043,609 | A | 3/2000 | George et al. |
| 6,049,177 | A | 4/2000 | Felper |
| 6,072,282 | A | 6/2000 | Adamson |
| 6,104,146 | A | 8/2000 | Chou et al. |
| 6,108,215 | A | 8/2000 | Kates et al. |
| 6,114,814 | A | 9/2000 | Shannon et al. |
| 6,121,733 | A | 9/2000 | Nilssen |
| 6,127,785 | A | 10/2000 | Williams |
| 6,127,786 | A | 10/2000 | Moisin |
| 6,137,240 | A | 10/2000 | Bogdan |
| 6,150,772 | A | 11/2000 | Crane |
| 6,169,375 | B1 | 1/2001 | Moisin |
| 6,181,066 | B1 | 1/2001 | Adamson |
| 6,181,083 | B1 | 1/2001 | Moisin |
| 6,181,084 | B1 | 1/2001 | Lau |
| 6,188,553 | B1 | 2/2001 | Moisin |
| 6,198,234 | B1 | 3/2001 | Henry |
| 6,198,236 | B1 | 3/2001 | O'Neill |
| 6,215,256 | B1 | 4/2001 | Ju |
| 6,218,788 | B1 | 4/2001 | Chen et al. |
| 6,259,615 | B1 | 7/2001 | Lin |
| 6,281,636 | B1 | 8/2001 | Okutsu et al. |
| 6,281,638 | B1 | 8/2001 | Moisin |
| 6,307,765 | B1 | 10/2001 | Choi |
| 6,310,444 | B1 | 10/2001 | Chang |
| 6,316,881 | B1 | 11/2001 | Shannon et al. |
| 6,320,329 | B1 | 11/2001 | Wacyk |
| 6,323,602 | B1 | 11/2001 | De Groot et al. |
| 6,344,699 | B1 | 2/2002 | Rimmer |
| 6,362,577 | B1 | 3/2002 | Ito et al. |
| 6,396,722 | B2 | 5/2002 | Lin |
| 6,417,631 | B1 | 7/2002 | Chen et al. |
| 6,420,839 | B1 | 7/2002 | Chiang et al. |
| 6,433,492 | B1 | 8/2002 | Buonavita |
| 6,441,943 | B1 | 8/2002 | Roberts et al. |
| 6,445,141 | B1 | 9/2002 | Kastner et al. |
| 6,459,215 | B1 | 10/2002 | Nerone et al. |
| 6,459,216 | B1 | 10/2002 | Tsai |
| 6,469,922 | B2 | 10/2002 | Choi |
| 6,472,827 | B1 | 10/2002 | Nilssen |
| 6,472,876 | B1 | 10/2002 | Notohamiprodjo et al. |
| 6,486,618 | B1 | 11/2002 | Li |
| 6,494,587 | B1 | 12/2002 | Shaw et al. |
| 6,501,234 | B2 | 12/2002 | Lin et al. |
| 6,509,696 | B2 | 1/2003 | Bruning et al. |
| 6,515,427 | B2 | 2/2003 | Oura et al. |
| 6,515,881 | B2 | 2/2003 | Chou et al. |
| 6,522,558 | B2 | 2/2003 | Henry |
| 6,531,831 | B2 | 3/2003 | Chou et al. |
| 6,534,934 | B1 | 3/2003 | Lin et al. |
| 6,559,606 | B1 | 5/2003 | Chou et al. |
| 6,570,344 | B2 | 5/2003 | Lin |
| 6,628,093 | B2 | 9/2003 | Stevens |
| 6,633,138 | B2 | 10/2003 | Shannon et al. |
| 6,680,834 | B2 | 1/2004 | Williams |
| 6,717,371 | B2 | 4/2004 | Klier et al. |
| 6,717,372 | B2 | 4/2004 | Lin et al. |
| 6,765,354 | B2 | 7/2004 | Klein et al. |
| 6,781,325 | B2 | 8/2004 | Lee |
| 6,784,627 | B2 | 8/2004 | Suzuki et al. |
| 6,804,129 | B2 | 10/2004 | Lin |
| 6,864,867 | B2 | 3/2005 | Biebl |
| 6,870,330 | B2 | 3/2005 | Choi |
| 6,922,023 | B2 | 7/2005 | Hsu et al. |
| 6,930,893 | B2 | 8/2005 | Vinciarelli |
| 6,936,975 | B2 | 8/2005 | Lin et al. |
| 7,242,147 | B2 | 7/2007 | Jin |
| 8,598,795 | B2 * | 12/2013 | Jin ..... 315/186 |
| 2001/0036096 | A1 | 11/2001 | Lin |
| 2002/0030451 | A1 | 3/2002 | Moisin |
| 2002/0097004 | A1 | 7/2002 | Chiang et al. |
| 2002/0135319 | A1 | 9/2002 | Bruning et al. |
| 2002/0140538 | A1 | 10/2002 | Yer et al. |
| 2002/0145886 | A1 | 10/2002 | Stevens |
| 2002/0171376 | A1 | 11/2002 | Rust et al. |
| 2002/0180380 | A1 | 12/2002 | Lin |
| 2002/0180572 | A1 | 12/2002 | Kakehashi et al. |
| 2002/0181260 | A1 | 12/2002 | Chou et al. |
| 2002/0195971 | A1 | 12/2002 | Qian et al. |
| 2003/0001524 | A1 | 1/2003 | Lin et al. |
| 2003/0015974 | A1 | 1/2003 | Klier et al. |
| 2003/0080695 | A1 | 5/2003 | Ohsawa |

(56) References Cited

U.S. PATENT DOCUMENTS

| | | | |
|---|---|---|---|
| 2003/0090913 | A1 | 5/2003 | Che-Chen et al. |
| 2003/0117084 | A1 | 6/2003 | Stack |
| 2003/0122502 | A1 | 7/2003 | Clauberg et al. |
| 2003/0141829 | A1 | 7/2003 | Yu et al. |
| 2004/0000879 | A1 | 1/2004 | Lee |
| 2004/0032223 | A1 | 2/2004 | Henry |
| 2004/0155596 | A1 | 8/2004 | Ushijima et al. |
| 2004/0257003 | A1 | 12/2004 | Hsieh et al. |
| 2004/0263092 | A1 | 12/2004 | Liu |
| 2005/0093471 | A1 | 5/2005 | Jin |
| 2005/0093472 | A1 | 5/2005 | Jin |
| 2005/0093482 | A1 | 5/2005 | Ball |
| 2005/0093483 | A1 | 5/2005 | Ball |
| 2005/0093484 | A1 | 5/2005 | Ball |
| 2005/0099143 | A1 | 5/2005 | Kohno |
| 2005/0156539 | A1 | 7/2005 | Ball |
| 2005/0162098 | A1 | 7/2005 | Ball |
| 2005/0225261 | A1 | 10/2005 | Jin |
| 2006/0022612 | A1 | 2/2006 | Henry |
| 2008/0061716 | A1 | 3/2008 | Kim |
| 2008/0116816 | A1 | 5/2008 | Neuman et al. |
| 2008/0136769 | A1 | 6/2008 | Kim et al. |
| 2010/0109560 | A1 | 5/2010 | Yu et al. |
| 2010/0194199 | A1 | 8/2010 | Kimura et al. |
| 2010/0237802 | A1 | 9/2010 | Aso |
| 2011/0068700 | A1 | 3/2011 | Fan |

FOREIGN PATENT DOCUMENTS

| | | | |
|---|---|---|---|
| EP | 0597661 | | 5/1994 |
| EP | 0647021 | A1 | 9/1994 |
| EP | 1956288 | A1 | 8/2008 |
| EP | 2278857 | A2 | 1/2011 |
| JP | 5-90897 | | 12/1993 |
| JP | 06168791 | A | 6/1994 |
| JP | 8-204488 | | 8/1996 |
| JP | 11305196 | A | 11/1999 |
| TW | 485701 | | 5/2002 |
| TW | 556860 | | 1/2003 |
| TW | 0554643 | | 9/2003 |
| TW | 200501829 | | 1/2005 |
| WO | WO 94/15444 | | 7/1994 |
| WO | WO 96/38024 | | 11/1996 |

OTHER PUBLICATIONS

Bradley, D.A., "Power Electronics" 2nd Edition; Chapman & Hall, 1995; Chapter 1, pp. 1-38.

Dubey, G. K., "Thyristorised Power Controllers"; Halsted Press, 1986; pp. 74-77.

Supplementary European Search Report for Application No. EP 04794179, dated May 15, 2007.

Examination Report for Application No. EP 04794179, dated Oct. 16, 2007.

Taiwan Examination Report for Application No. 094110958, dated Mar. 20, 2008, 9 pages.

Baddela S M et al; Parallel Connected LEDs Operated at High Frequency to Improve Current Sharing; Industry Applications Conference 2004, 39th IAS Annual Meeting, pp. 1677-1681, published Oct. 2004, IEEE Piscataway, NJ.

Sungjin Choi et al; Symmetric Current Balancing Circuit for Multiple DC Loads; Applied Power Electronics Conference and Exposition 2010; pp. 512-518, published Feb. 2010, IEEE Piscataway, NJ.

Werner Thomas et al; "A Novel Low-Cost Current-Sharing Method for Automotive LED Lighting Systems"; 13th European Conference on Power Electronics and Applications, 2009; pp. 1-10, published Sep. 2009, IEEE Piscataway, NJ.

International Search Report by European Patent Office for PCT application PCT/US2011/042909 dated Feb. 6, 2012.

Written Opinion of the International Searching Authority by European Patent Office for PCT application PCT/US2011/042909 dated Feb. 6, 2012.

International Search Report by European Patent Office for PCT application PCT/US2012/035924 dated Oct. 23, 2012.

Written Opinion of the International Searching Authority by European Patent Office for PCT application PCT/US2012/035924 dated Oct. 23, 2012.

* cited by examiner

HIGH EFFICIENCY LED DRIVING METHOD FOR ODD NUMBER OF LED STRINGS

CROSS-REFERENCE TO RELATED APPLICATION

This application is a continuation-in-part of U.S. patent application Ser. No. 13/461,793 filed May 2, 2012, entitled "High Efficiency LED Driving Method", which claims priority from U.S. Provisional Patent Application Ser. No. 61/482,116 filed May 3, 2011, entitled "High Efficiency LED Driving Method", the entire contents of both of which are incorporated herein by reference.

FIELD OF THE INVENTION

The present invention relates to the field of solid state lighting, and in particular to an LED driving arrangement with a balancer and a capacitively coupled driving signal.

BACKGROUND OF THE INVENTION

Light emitting diodes (LEDs) have become very popular for use as lighting devices due to their advantages of high efficiency, long life, mechanical compactness and robustness, and low voltage operation, without limitation. Application areas include liquid crystal display (LCD) backlight, general lighting, and signage display. LEDs exhibit similar electrical characteristics to diodes, i.e. LEDs only conduct current when the forward voltage across the device reaches its conduction threshold, denoted $V_F$, and when the forward voltage increases above $V_F$ the current flowing through the device increases sharply. As a result a particular drive circuit has to be furnished in order to control the LED current stably.

The existing approach in today's market normally uses a switching type DC to DC converter, typically in a current control mode, to drive the LED lighting device. Because of the limited power capacity of a single LED device, in most applications multiple LED's are connected in series to form a LED string, and multiple such LED strings work together, typically in parallel, to produce the desired light intensity. In multiple LED string applications a DC to DC converter is normally employed to supply a DC voltage sufficient for the LED operation, however because the operating voltage of LEDs have a wide tolerance (+/−5% to +/−10%), an individual control circuit has to be deployed with each LED string to regulate its current. For simplicity, such a current regulator typically employs a linear regulation technique, wherein a power regulation device is connected in series with the LED string and the LED current is controlled by adjusting the voltage drop across the power regulating device. Unfortunately, such an approach consumes excessive power and generates excessive heat because of the power dissipation of the linear regulation devices. In some approaches a switching type DC to DC converter is provided for each LED string. Such an approach yields a high efficiency operation but the associated costs also increase dramatically.

What is needed, and not provided by the prior art, is an LED drive method with high operating efficiency and a low system cost, which provides a balancing function between the various LED strings of a multiple LED string luminaire.

SUMMARY OF THE INVENTION

Accordingly, it is a principal object of the present invention to overcome at least some of the disadvantages of the prior art. This is provided in certain embodiments by an arrangement wherein a plurality of LED strings are driven with a balanced drive signal, i.e. a drive signal wherein the positive side and negative side are forced to be of equal energy over time. In a preferred embodiment, the drive signal is balanced responsive to a capacitor provided between a switching network and a driving transformer. Balance of current between various LED strings is provided by a balancing transformer. In one embodiment, the current of a pair of LED strings is balanced responsive to the capacitor and the current of the third LED string is balanced with the current of the pair of LED strings responsive to the balancing transformer.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
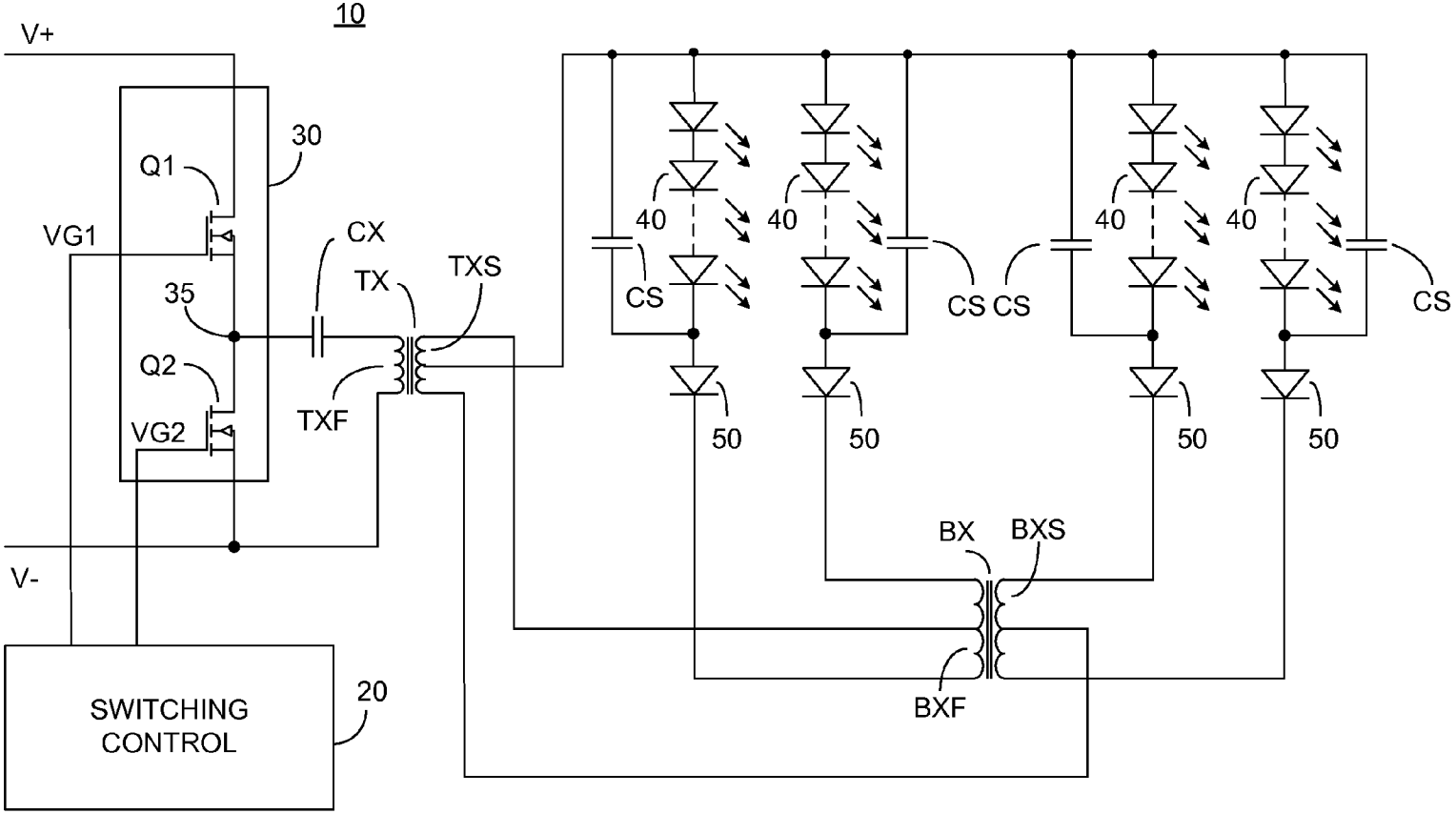
FIG. 1 illustrates a high level schematic diagram of an embodiment of a driving arrangement for four LED strings wherein the anode end of each of the LED strings are commonly coupled to the center tap of a driving transformer, and wherein the cathode ends of the LED strings are each coupled to respective ends of windings of a balancing transformer via respective unidirectional electronic valves.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 illustrates a high level schematic diagram of an embodiment of a driving arrangement 10 comprising: a switching control circuit 20; a switching bridge 30 comprising a first electronically controlled switch Q1 and a second electronically controlled switch Q2; a DC blocking capacitor CX; a driving transformer TX comprising a first winding TXF magnetically coupled to a second winding TXS; first, second, third and fourth LED strings 40; a balancing transformer BX comprising a first winding BXF magnetically coupled to a second winding BXS; a first, second, third and fourth smoothing capacitors CS; and a first, second, third and fourth unidirectional electronic valve 50. First and second electronically controlled switches Q1, Q2 are illustrated without limitation as NMOSFETs, however this is not meant to be limiting in any way. Switching bridge 30 is illustrated as a half bridge, however this is not meant to be limiting in any way, and in particular embodiment a full bridge is implemented without exceeding the scope.

A first output of switching control circuit 20, denoted VG1, is coupled to the control input of first electronically controlled switch Q1 of switching bridge 30, and a second output of switching control circuit 20, denoted VG2, is coupled to the control input of second electronically controlled switch Q2 of switching bridge 30. The drain of first electronically controlled switch Q1 is coupled to a source of electrical power, denoted V+, and the source of first electronically controlled switch Q1 is coupled to drain of second electronically controlled switch Q2 and to a first end of DC blocking capacitor CX. The common node of the source of first electronically controlled switch Q1, the drain of second electronically controlled switch Q2, and the first end of DC blocking capacitor CX is denoted node 35. The second end of DC blocking capacitor CX is coupled to a first end of first winding TXF, and a second end of first winding TXF is coupled to the source of second electronically controlled switch Q2, and to the return of the source of electrical power, denoted V−.

A center tap of second winding TXS is coupled to the anode end of each of the LED strings 40 and to a first end of each of the smoothing capacitors CS. The cathode end of each of the LED strings 40 is coupled to a second end of a respective smoothing capacitor CS and to the anode of a respective unidirectional electronic valve 50. The cathode of a first unidirectional electronic valve is coupled to a first end of first winding BXF, the cathode of a second unidirectional electronic valve 50 is coupled to a second end of first winding BXF, the cathode of a third unidirectional electronic valve 50 is coupled to a first end of second winding BXS, and the cathode of a fourth unidirectional electronic valve 50 is coupled to a second end of second winding BXS. A center tap of first winding BXF is coupled to a first end of second winding TXS, and a center tap of second winding BXS is coupled to a second end of second winding TXS.

In operation, and as will be described further below, driving arrangement 10 provides a balanced current for 4 LED strings 40 with a single balancing transformer BX. The 4 LED strings 40 are configured with a common anode structure. The balancing transformer BX has two center tapped windings, each of the two windings BXF and BXS having the same number of turns. The center taps of BXF, BXS and TXS are each preferably arranged such that an equal number of turns are exhibited between the center tap and the respective opposing ends of the winding.

Switching control circuit 20 is arranged to alternately close first electronically controlled switch Q1 and second electronically controlled switch Q2 so as to provide a switching cycle having a first period during which electrical energy is output from second winding TXS with a first polarity and a second period during which electrical energy is output from second winding TXS with a second polarity, the second polarity opposite the first polarity.

During the first period, when the end of second winding TXS coupled to the center tap of first winding BXF is negative in relation to the center tap of second winding TXS, current flows through the two LED strings 40 coupled to the respective ends of first winding BXF. During the second period, when the end of second winding TXS coupled to the center tap of second winding BXS is negative in relation to the center tap of second winding TXS, current flows through the two LED strings 40 coupled to the respective ends of second winding BXS. The current through the two LED strings 40 conducting during the first period are forced to be equal by the balancing effect of the two winding halves of first winding BXF, and current through the two LED strings 40 conducting during the second period are forced to be equal by the balancing effect of the two winding halves of second winding BXS. DC blocking capacitor CX ensures that the current flowing through first winding TXF, and hence transferred to second winding TXS, during each of the two periods is equal, because DC blocking capacitor CX does not couple DC current in steady state. In the event that the average operating voltage of the two LED strings 40 coupled to first winding BXF is different than the average operating voltage of the two LED strings 40 coupled to second winding BXS, a DC bias will automatically develop across DC blocking capacitor CX to offset the average operating voltage difference. The DC bias acts to maintain an equal total current for each of the two string groups, i.e. the first group comprising two LED strings 40 coupled to first winding BXF and the second group comprising two LED strings 40 coupled to second winding BXS.

To further clarify and illustrate this relationship, we denote the current through the two LED strings 40 coupled to first winding BXF, respectively, as $I_{LED1}$ and $I_{LED2}$. We further denote the current through the two LED strings 40 coupled to second winding BXS, respectively, as $I_{LED3}$ and $I_{LED4}$. This results in the following relations.

$$I_{LED1}+I_{LED2}=I_{LED3}+I_{LED4} \text{ (Responsive to } CX\text{)} \quad \text{EQ. 1}$$

$$I_{LED1}=I_{LED2},\ I_{LED3}=I_{LED4} \text{ (Responsive to } BX\text{)} \quad \text{EQ. 2}$$

And as result of EQ. 1 and EQ. 2: $I_{LED1}=I_{LED2}=I_{LED3}=I_{LED4}$

Smoothing capacitors CS are each connected in parallel with a respective one of LED strings 40 to smooth out any ripple current and maintain the associated LED current to be nearly a constant direct current. Unidirectional electronic valves 50 are arranged to block any reverse voltage to LED strings 40 and further prevent bleeding of current between respective smoothing capacitors CS.

Figure 2:
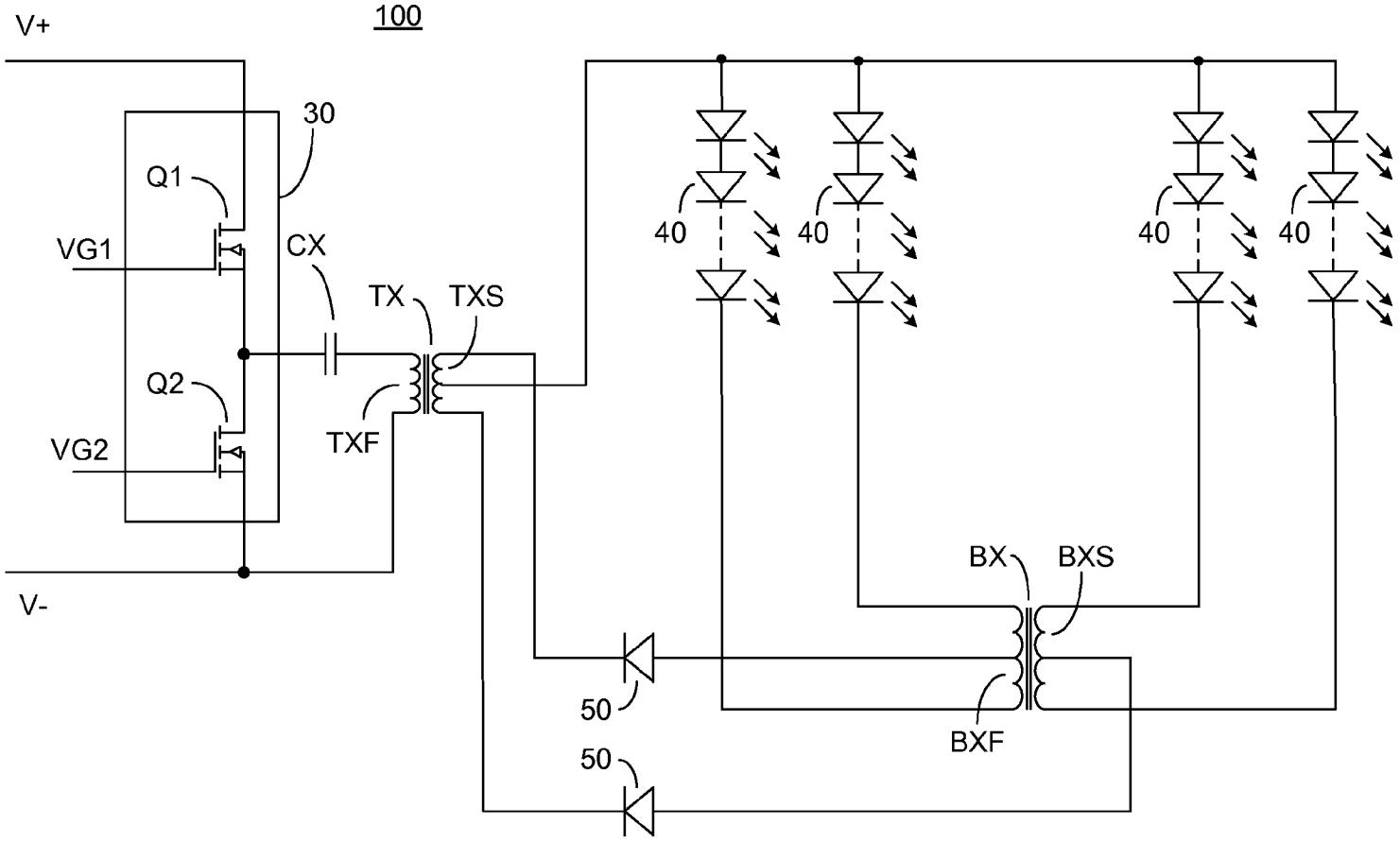
FIG. 2 illustrates a high level schematic diagram of an embodiment of a driving arrangement for four LED strings wherein the anode end of each of the LED strings are commonly coupled to the center tap of a driving transformer, the cathode ends are each coupled to respective ends of windings of a balancing transformer, and the center taps of the balancing transformer windings are coupled to the driving transformer second winding ends via respective unidirectional electronic valves.

FIG. 2 illustrates a high level schematic diagram of an embodiment of a driving arrangement 100 for four LED strings 40, wherein the anode end of each LED string 40 is commonly coupled to the center tap of second winding TXS of driving transformer TX, the cathode ends of the various LED strings 40 are each coupled to respective ends of windings of balancing transformer BX, and the center taps of the balancing transformer windings, BXS and BXF, are coupled to driving transformer second winding TXS via respective unidirectional electronic valves 50. Driving arrangement 100 is a simplified version of driving arrangement 10, wherein LED strings 40 are allowed to operate with a rippled current, and thus smoothing capacitors CS are not supplied and only a single unidirectional electronic valve 50 is required for each two LED strings 40.

In some further detail, the center tap of second winding TXS is commonly coupled to the anode end of each of the four LED strings 40. The cathode end of first LED string 40 is coupled to a first end of first winding BXF; the cathode end of second LED string 40 is coupled to a second end of first winding BXF; the cathode end of third LED string 40 is coupled to a first end of second winding BXS; and the cathode end of fourth LED string 40 is coupled to a second end of second winding BXS. The center tap of first winding BXF is coupled via a respective unidirectional electronic valve 50 to a first end of second winding TXS and the center tap of second winding BXS is coupled via a respective unidirectional electronic valve 50 to a second end of second winding TXS. Switching control circuit 20 is not shown for simplicity, and the connections of switching bridge 30, DC blocking capacitor CX and first winding TXF are as described above in relation to driving arrangement 10.

The operation of driving arrangement 100 is in all respects similar to the operation of driving arrangement 10, and thus in the interest of brevity will not be further detailed.

Figure 3:
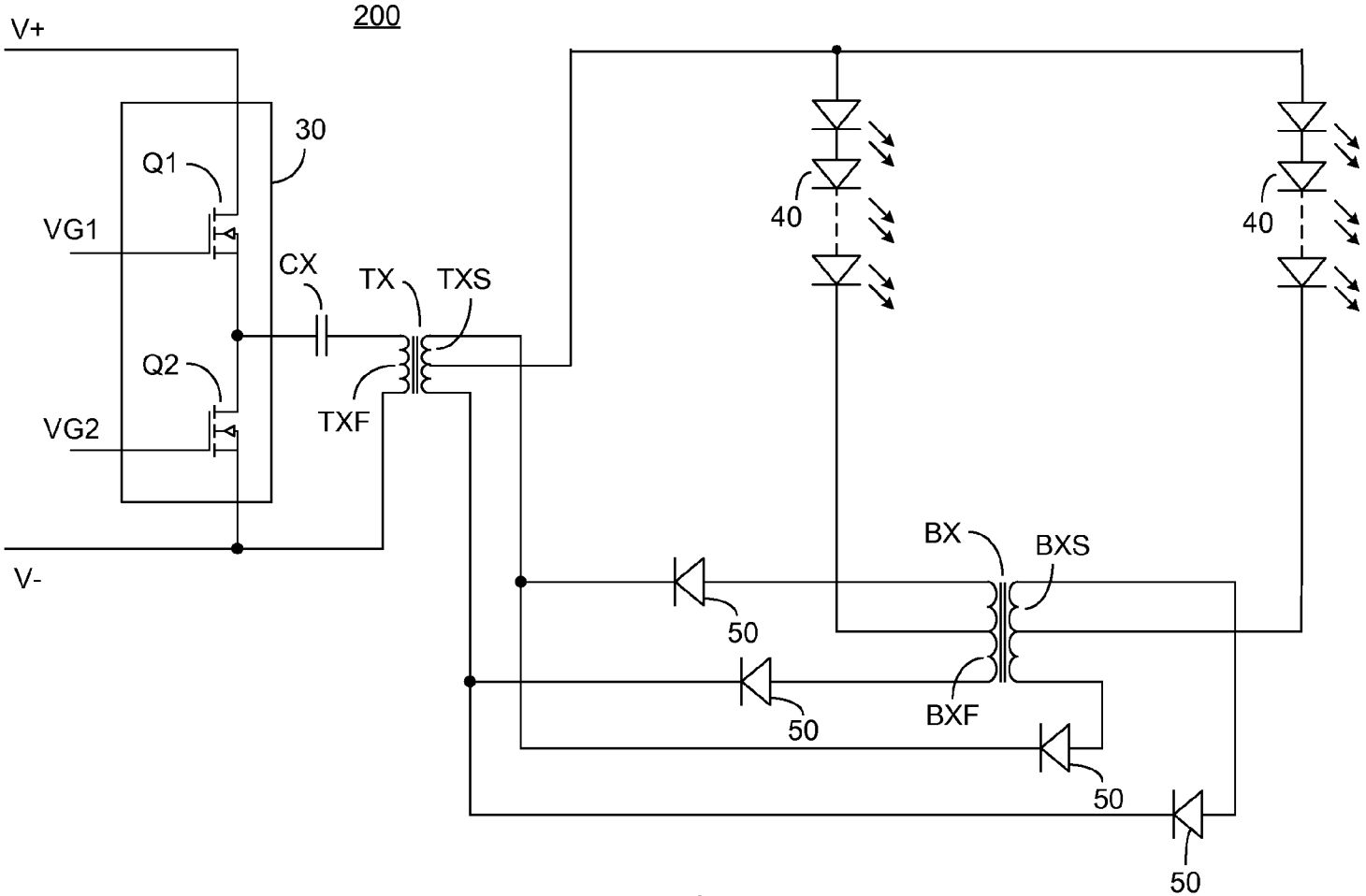
FIG. 3 illustrates a high level schematic diagram of an embodiment of a driving arrangement for two LED strings wherein the anode end of each of the LED strings are commonly coupled to the center tap of a driving transformer, the cathode ends of the LED strings are each coupled to a center tap of respective windings of a balancing transformer, and the balancing transformer winding ends are coupled to the driving transformer second winding ends via respective unidirectional electronic valves.

FIG. 3 illustrates a high level schematic diagram of an embodiment of a driving arrangement 200 having two LED strings 40. Switching control circuit 20 is not shown for simplicity, and the connections of switching bridge 30, DC blocking capacitor CX and first winding TXF are as described above in relation to driving arrangement 10. The anode end of each of the LED strings 40 are commonly coupled to the center tap of second winding TXS of driving transformer TX. The cathode end of a first LED string 40 is coupled to a center tap of first winding BXF of balancing transformer BX, and the cathode end of a second LED string 40 is coupled to a center tap of second winding BXS of balancing transformer BX. The ends of first winding BXF are each coupled via a respective unidirectional electronic valve 50 to respective ends of second winding TXS of driving transformer TX and respective ends of second winding BXF are each coupled via a respective unidirectional electronic valve 50 to respective ends of second winding TXS of driving transformer TX.

Each winding of balancing transformer BX thus drives a single LED string 40. The LED strings 40 each conduct in both half cycles and therefore the ripple current frequency is twice that of the switching frequency of Q1 and Q2. Opposing halves of first winding BXF conduct during the respective first and second periods generated by switching control circuit 20 and opposing halves of second winding BXS conduct during the respective first and second periods generated by switching control circuit 20 (not shown). Therefore the core of balancer transformer BX experiences an AC excitation. The connection polarity of balancer windings BXF and BXS is such so as to always keep the magnetization force generated by the current of the two LED strings 40 in opposite directions, and by such magnetization force the current of the two LED strings 40 are forced to be equal.

Driving arrangements 10, 100 and 200 illustrate a common anode structure for LED strings 40, however this is not meant to be limiting in any way, as will be further illustrated below.

Figure 4:
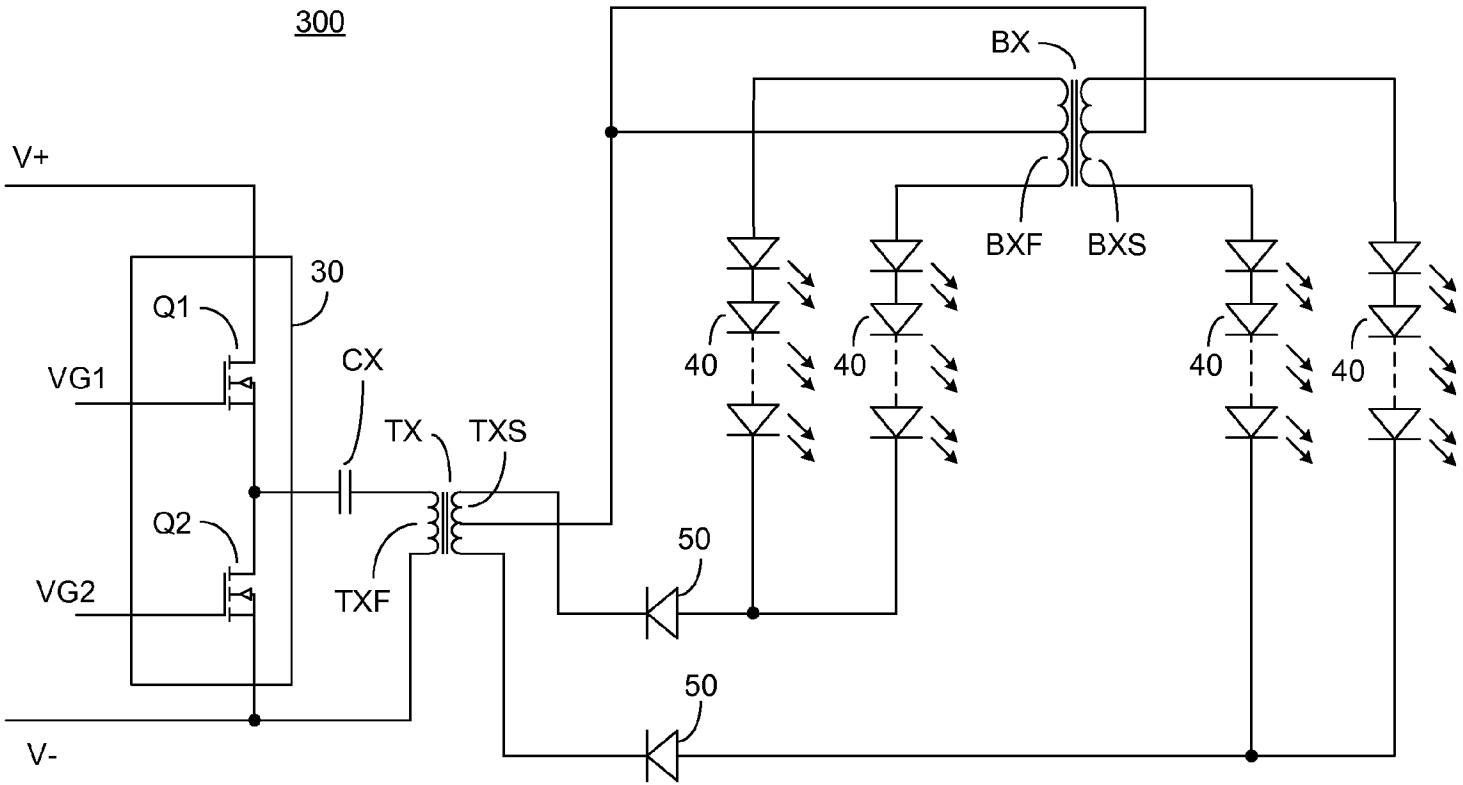
FIG. 4 illustrates a high level schematic diagram of an embodiment of a driving arrangement for four LED strings wherein the cathode ends of a first two of the LED strings are commonly coupled to a first end of the second winding of a driving transformer, the cathode ends of a second two of the LED strings are commonly coupled to a second end of the second winding of the driving transformer, and the anode ends of the LED strings are each coupled to respective ends of windings of a balancing transformer.

FIG. 4 illustrates a high level schematic diagram of an embodiment of a driving arrangement 300 exhibiting four LED strings 40. Switching control circuit 20 is not shown for simplicity, and the connections of switching bridge 30, DC blocking capacitor CX and first winding TXF are as described above in relation to driving arrangement 10. The cathode ends of a first two LED strings 40 are commonly coupled to a first end of second winding TXS of driving transformer TX via a common respective unidirectional electronic valve 50 and the cathode ends of a second two LED strings 40 are commonly coupled to a second end of second winding TXS of driving transformer TX via a common respective unidirectional electronic valve 50. The anode end of first LED string 40 is coupled to a first end of first winding BXF of balancing transformer BS; the anode end of second LED string 40 is coupled to a second end of first winding BXF of balancing transformer BS; the anode end of third LED string 40 is coupled to a first end of second winding BXS of balancing transformer BS; and the anode end of fourth LED string 40 is coupled to a second end of second winding BXS of balancing transformer BS. The center taps of each of first winding BXF and second winding BXS are commonly coupled to the center tap of second winding TXS of driving transformer TX.

The operation of driving arrangement 300 is in all respects similar to the operation of driving arrangement 100, with first and second LED 40 providing illumination during one of the first and second periods, and the third and fourth LED 40 providing illumination during the other of the first and second periods, and in the interest of brevity will not be detailed further.

Figure 5:
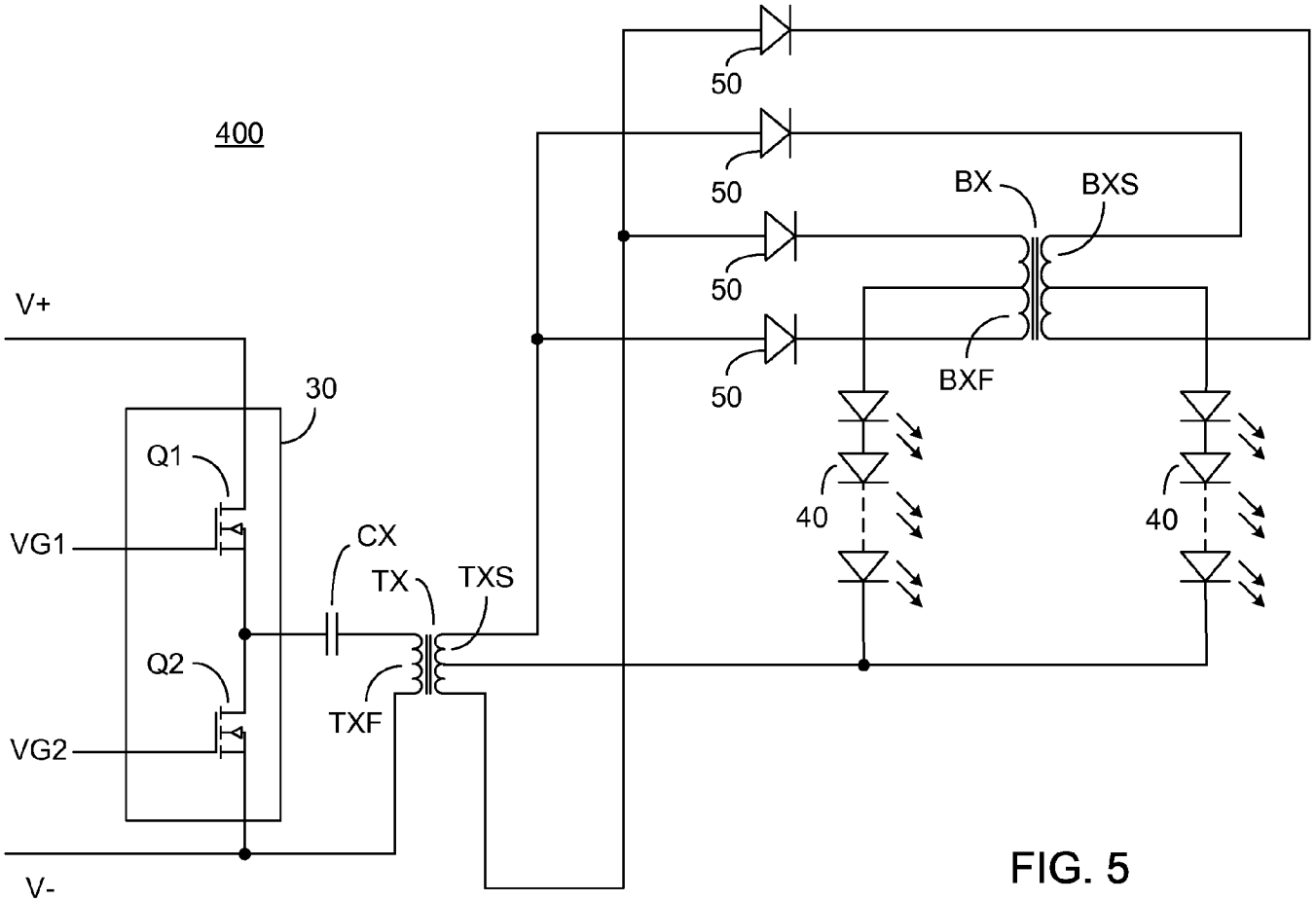
FIG. 5 illustrates a high level schematic diagram of an embodiment of a driving arrangement for two LED strings wherein the cathode end of each of the LED strings are commonly coupled to the center tap of a driving transformer, the anode ends of the LED strings are each coupled to a center tap of respective windings of a balancing transformer, and the balancing transformer winding ends are coupled to the driving transformer second winding ends via respective unidirectional electronic valves.

FIG. 5 illustrates a high level schematic diagram of an embodiment of a driving arrangement 400 for two LED strings 40 wherein the cathode end of each of the LED strings 40 are commonly coupled to the center tap of second winding TXS of driving transformer TX. Switching control circuit 20 is not shown for simplicity, and the connections of switching bridge 30, DC blocking capacitor CX and first winding TXF are as described above in relation to driving arrangement 10. The anode end of first LED string 40 is coupled to the center tap of first winding BXF of balancing transformer BX and the anode end of second LED string 40 is coupled to the center tap of second winding BXS of balancing transformer BX. A first end of first winding BXF is coupled via a respective unidirectional electronic valve 50 to a first end of second winding TXS of driving transformer TX; a second end of first winding BXF is coupled via a respective unidirectional electronic valve 50 to a second end of second winding TXS of driving transformer TX; a first end of second winding BXS is coupled via a respective unidirectional electronic valve 50 to a first end of second winding TXS of driving transformer TX; and a second end of second winding BXS is coupled via a respective unidirectional electronic valve 50 to a second end of second winding TXS of driving transformer TX.

The operation of driving arrangement 400 are in all respects identical with the operation of driving arrangement 200, with the appropriate changes in polarity as required, and thus in the interest of brevity will not be further detailed.

Figure 6:
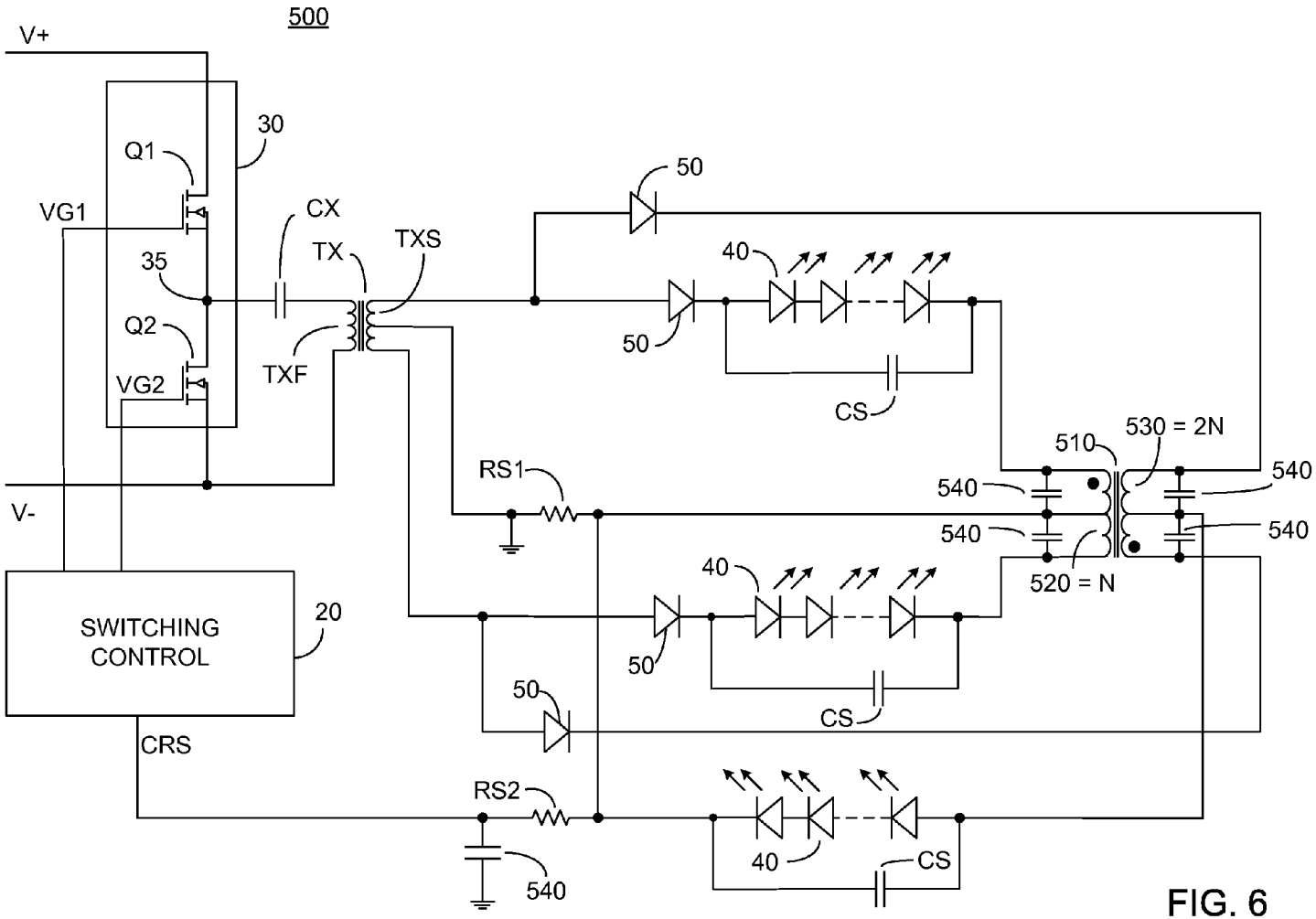
FIG. 6 illustrates a high level schematic diagram of an embodiment of a driving arrangement for three LED strings wherein the anode end of each of a first and second LED string is coupled to a respective end of a winding of a driving transformer, the cathode end of each of the first and second LED string is coupled to a respective end of a first winding of a balancing transformer and the anode end of a third LED string is coupled to a second winding of the balancing transformer.

FIG. 6 illustrates a high level schematic diagram of an embodiment of a driving arrangement 500 comprising: a switching control circuit 20; a switching bridge 30 comprising a first electronically controlled switch Q1 and a second electronically controlled switch Q2; a DC blocking capacitor CX; a driving transformer TX comprising a first winding TXF magnetically coupled to a second winding TXS; a first, second and third LED string 40; a balancing transformer 510 comprising a first winding 520 magnetically coupled to a second winding 530; a first, second and third smoothing capacitor CS; a plurality of capacitors 540; and a first, second, third and fourth unidirectional electronic valve 50. The number of turns of second winding 530, denoted 2N, is twice the number of turns of first winding 520, denoted N.

A first output of switching control circuit 20, denoted VG1, is coupled to the control input of first electronically controlled switch Q1 of switching bridge 30, and a second output of switching control circuit 20, denoted VG2, is coupled to the control input of second electronically controlled switch Q2 of switching bridge 30. The drain of first electronically controlled switch Q1 is coupled to a source of electrical power, denoted V+, and the source of first electronically controlled switch Q1 is coupled to drain of second electronically controlled switch Q2 and to a first end of DC blocking capacitor CX. The common node of the source of first electronically controlled switch Q1, the drain of second electronically controlled switch Q2, and the first end of DC blocking capacitor CX is denoted node 35. The second end of DC blocking capacitor CX is coupled to a first end of first winding TXF, and a second end of first winding TXF is coupled to the source of second electronically controlled switch Q2, and to the return of the source of electrical power, denoted V−.

A first end of second winding TXS is coupled to the anode of each of first and second unidirectional electronic valves 50. The cathode of first unidirectional electronic valve 50 is coupled to the anode end of first LED string 40 and to a first end of first smoothing capacitor CS. The cathode end of first LED string 40 is coupled to a second end of first smoothing capacitor CS and to a first end of first winding 520 of balancing transformer 510, denoted with a dot for polarity. The cathode of second unidirectional electronic valve 50 is coupled to a first end of second winding 530 of balancing transformer 510. A second end of second winding TXS is coupled to the anode of each of third and fourth unidirectional electronic valves 50. The cathode of third unidirectional electronic valve 50 is coupled to the anode end of second LED string 40 and to a first end of second smoothing capacitor CS. The cathode end of second LED string 40 is coupled to a second end of second smoothing capacitor CS and to a second end of first winding 520. The cathode of fourth unidirectional electronic valve is coupled to a second end of second winding 530, denoted with a dot for polarity. A center tap of second winding TXS is coupled to a common potential. A center tap of first winding 520 is coupled to a first end of sense resistor RS1 and a second end of sense resistor RS1 is coupled to the common potential.

A center tap of second winding 530 is coupled to the anode end of third LED string 40 and to a first end of third smoothing capacitor CS. The cathode end of third LED string 40 is coupled to a second end of third smoothing capacitor CS, to the first end of sense resistor RS1 and to a first end of sense resistor RS2. A second end of sense resistor RS2 is coupled via a capacitor 540 to the common potential, the common node of sense resistor RS2 and capacitor 540 coupled to an input of switching control circuit 20 and denoted CRS.

A respective capacitor 540 is optionally provided between each end of first winding 520 and the center tap of first winding 520. A respective capacitor 540 is optionally provided between each end of second winding 530 and the center tap of second winding 530.

In operation, and as will be described further below, driving arrangement 500 provides a balanced current for 3 LED strings 40 with a single balancing transformer 510. The center taps of 520, 530 and TXS are each preferably arranged such that an equal number of turns are exhibited between the center tap and the respective opposing ends of the winding.

Switching control circuit 20 is arranged to alternately close first electronically controlled switch Q1 and second electronically controlled switch Q2 so as to provide a switching cycle having a first period during which electrical energy is output from second winding TXS with a first polarity and a second period during which electrical energy is output from second winding TXS with a second polarity, the second polarity opposite the first polarity.

During the first period, when the end of second winding TXS coupled to first unidirectional electronic valve 50 is positive in relation to the center tap of second winding TXS, current flows through first LED string 40 and through third LED string 40. During the second period, when the end of second winding TXS coupled to third unidirectional electronic valve 50 is positive in relation to the center tap of second winding TXS, current flows through second LED string 40 and through third LED string 40. DC blocking capacitor CX ensures that the current flowing through first winding TXF, and hence transferred to second winding TXS, during each of the two periods is equal, because DC blocking capacitor CX does not couple DC current in steady state. In the event that the average operating voltage of first LED string 40 is different than the average operating voltage of second LED string 40, a DC bias will automatically develop across DC blocking capacitor CX to offset the average operating voltage difference. The DC bias thus acts to maintain an equal total current for each of first and second LED strings 40.

As mentioned above, during the first period of the switching cycle current flows through third LED string 40, via second unidirectional electronic valve 50 and second winding 530, and during the second period of the switching cycle current flows through third LED string 40, via fourth unidirectional electronic valve 50 and second winding 530. The magnetic coupling between first winding 520 and second winding 530 of balancing transformer 510 ensures that the current flowing through second winding 530 and third LED string 40 is equal to the average current flowing through first LED string 40 and second LED string 40.

To further clarify and illustrate this relationship, we denote the current through first LED string 40 as $I_{LED1}$ and the current through second LED string 40 as $I_{LED2}$. We further denote the current through third LED string 40 as $I_{LED3}$. As described above, DC blocking capacitor CX maintains an equal current in first LED string 40 and second LED string 40.

As further described above, the number of turns in second winding 530 is twice the number of turns in first winding 520, therefore the current flowing through second winding 530 is half the current flowing through first winding 520. The relationship between $I_{LED3}$, $I_{LED1}$ and $I_{LED2}$ over an entire switching cycle is thus given as:

$$I_{LED3}=0.5*I_{LED1}+0.5*I_{LED2} \quad \text{EQ. 1}$$

Since $I_{LED1}$ flows only during the first period of the switching cycle and $I_{LED2}$ flows only during the second period of the switching cycle, $I_{LED3}$ is equal to $0.5*I_{LED1}$ during the first period of the switching cycle and is equal to $0.5*I_{LED2}$ during the second period of the switching cycle. As described above, the average of $I_{LED1}$ is equal to the average of $I_{LED2}$, and thus in accordance with EQ. 1, over the entire switching cycle $I_{LED3}$ is equal to the average of $I_{LED1}$, and thus currents $I_{LED1}$, $I_{LED2}$ and $I_{LED3}$ are equal.

Smoothing capacitors CS are each connected in parallel with a respective one of LED strings 40 to smooth out any ripple current and maintain the associated LED current to be nearly a constant direct current. First and third unidirectional electronic valves 50 are arranged to block any reverse voltage to first and second LED strings 40 and second and fourth unidirectional electronic valves 50 are arranged to prevent bleeding of current from balancing transformer 510 to driving transformer TX. Switching control circuit 20 is arranged to sense the current of first, second and third LED strings 40 via sense resistors RS1 and RS2, smoothed by capacitor 540, and adjust the switching cycle responsive to the sensed current.

Capacitors 540 provide a circulation path for the inductive current, and provide additional filtering for the respective LED currents.

The above has been illustrated for simplicity with a certain polarity for unidirectional electronic valves 50, however this is not meant to be limiting in any way. The polarity of first, second, third and fourth unidirectional electronic valves 50 may be reversed, while reversing the polarity of the associated LED strings 40 without exceeding the scope.

Figure 7:
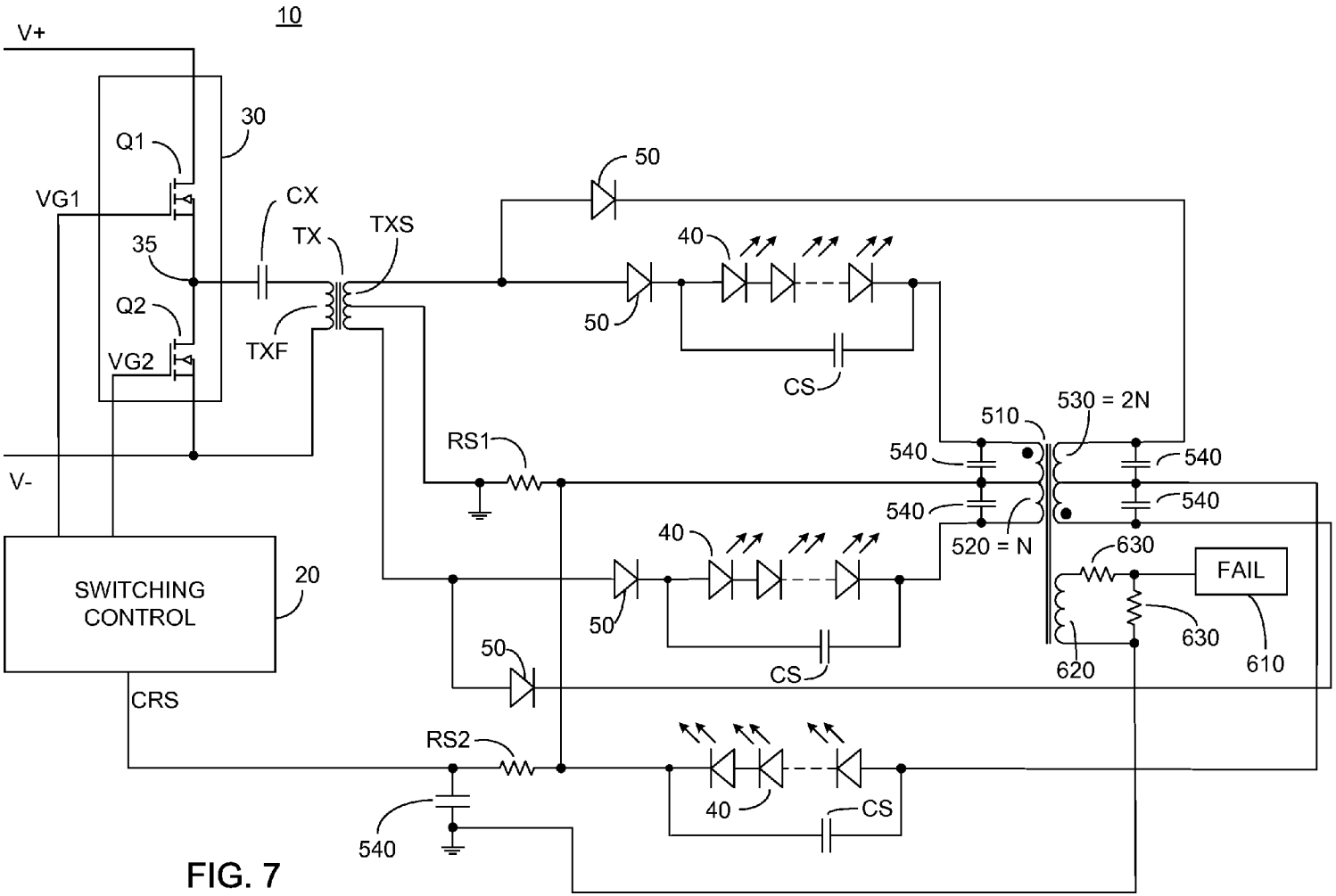
FIG. 7 illustrates a high level schematic diagram of the driving arrangement of FIG. 6, further comprising a fail detection circuit coupled to a third winding of the balancing transformer.

FIG. 7 illustrates a high level schematic diagram of an embodiment of a driving arrangement 600. Driving arrangement 600 is in all respects similar to driving arrangement 500 of FIG. 6 with the exception that a fail detection circuit 610 is provided and balancing transformer 510 exhibits a third winding 620 magnetically coupled to first winding 520 and second winding 530. A first end of third winding 620 is coupled to a first end of a first resistor 630 and a second end of third winding 620 is coupled to a first end of a second resistor 630 and to the common potential. A second end of each of first and second resistors 630 are commonly coupled to an input of fail detection circuit 610. In one embodiment, an output of fail detection circuit 610 is coupled to a respective input of switching control circuit 20 (not shown). The operation of driving arrangement 600 is in all respects similar to the operation of driving arrangement 500, as described above. In the event that one or more of first, second and third LED strings 40 exhibits an open or short circuit, the imbalance of currents in balancing transformer 510 will cause a current imbalance among windings 520 and 530 which will further result in a large current change in third winding 620. Fail detection circuit 610 is arranged to detect the voltage representation of the formed current change from the common node of resistors 630. In the event that the voltage representation represent a current greater than a predetermined value, a fail signal is output. In one embodiment, the fail signal is output to switching control circuit 20 which is arranged to cease the operation of switching bridge 30 responsive thereto.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described herein above. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

The invention claimed is:

1. A driving arrangement for light emitting diode (LED) based luminaire comprising:

a driving transformer comprising a first winding and a second winding, the second winding magnetically coupled to the first winding;

a switching control circuit;

a switching bridge comprising a pair of electronically controlled switches coupled to a common node, each of the pair of electronically controlled switches responsive to an output of the switching control circuit;

a direct current (DC) blocking capacitor coupled between the common node of said switching bridge and a first end of the primary winding of the driving transformer;

a balancing transformer comprising a first winding and a second winding, the second winding magnetically coupled to the first winding;

a first LED string;

a second LED string; and a third LED string, a first end of said first LED string coupled to a first end of the second winding of said driving transformer, and arranged to receive electrical energy there from;

a first end of said second LED string coupled to a second end of the second winding of said driving transformer, and arranged to receive electrical energy there from;

a second end of said first LED string coupled to a first end of the first winding of said balancing transformer;

a second end of said second LED string coupled to a second end of the first winding of said balancing transformer; and a first end of said third LED string coupled to the second winding of said balancing transformer, said switching control circuit arranged to provide a switching cycle comprising a first period wherein electrical energy is output from the second winding of said driving transformer with a first polarity, and a second period wherein electrical energy is output from the second winding of said driving transformer with a second polarity, the second polarity opposite the first polarity, said DC blocking capacitor arranged such that the total electrical energy output from the second winding of said driving transformer during the first period of the switching cycle is equal to the total electrical energy output from the second winding of said driving transformer during the second period of the switching cycle, and said balancing transformer arranged such that the average currents through said first LED string, said second LED string and said third LED string are equal.

2. The driving arrangement according to claim 1, wherein the number of turns of the second winding of said balancing transformer is twice the number of turns of the first winding of said balancing transformer.

3. The driving arrangement according to claim 1, further comprising a fail detection circuit, wherein said balancing transformer further comprises a third winding magnetically coupled to the first winding and second winding of said balancing transformer, said fail detection circuit coupled to the third winding of said balancing transformer and arranged to detect one of an open circuit and a short circuit in one of said first, second and third LED strings.

4. The driving arrangement according to claim 3, wherein said fail detection circuit comprises a current sensor, and wherein said detection of one of an open circuit and a short circuit is responsive to said current sensor sensing a current greater than a predetermined value.

5. The driving arrangement according to claim 1, wherein:

a first end of the second winding of said balancing transformer is further coupled to the first end of the second winding of said driving transformer;

a second end of the second winding of said balancing transformer is coupled to the second end of the second winding of said driving transformer; and said third LED string is coupled between a center tap of said second winding of said balancing transformer and a center tap of said second winding of said driving transformer.

6. The driving arrangement according to claim 5, wherein said coupling between the first end of said second winding of said driving transformer and the first end of the second winding of said balancing transformer is via a respective unidirectional electronic valve; and said coupling between the second end of said second winding of said driving transformer and the second end of the second winding of said balancing transformer is via a respective unidirectional electronic valve.

7. A driving arrangement for light emitting diode (LED) based luminaire comprising:

a means for driving having a first winding and a second winding, the second winding magnetically coupled to the first winding;

a means for switching;

a switching bridge comprising a pair of electronically controlled switches coupled to a common node, each of the pair of electronically controlled switches responsive to an output of the means for switching;

a direct current (DC) blocking capacitor coupled between the common node of said switching bridge and a first end of the primary winding of the means for driving;

a balancing transformer comprising a first winding and a second winding, the second winding magnetically coupled to the first winding;

a first LED string;

a second LED string; and a third LED string, a first end of said first LED string coupled to a first end of the second winding of said means for driving, and arranged to receive electrical energy there from;

a first end of said second LED string coupled to a second end of the second winding of said means for driving, and arranged to receive electrical energy there from;

a second end of said first LED string coupled to a first end of the first winding of said balancing transformer;

a second end of said second LED string coupled to a second end of the first winding of said balancing transformer; and a first end of said third LED string coupled to the second winding of said balancing transformer, said means for switching arranged to provide a switching cycle comprising a first period wherein electrical energy is output from the second winding of said driving transformer with a first polarity, and a second period wherein electrical energy is output from the second winding of said means for driving with a second polarity, the second polarity opposite the first polarity, said DC blocking capacitor arranged such that the total electrical energy output from the second winding of said means for driving during the first period of the switching cycle is equal to the total electrical energy output from the second winding of said means for driving during the second period of the switching cycle, and said balancing transformer arranged such that the average currents through said first LED string, said second LED string and said third LED string are equal.

8. The driving arrangement according to claim 7, wherein the number of turns of the second winding of said balancing transformer is twice the number of turns of the first winding of said balancing transformer.

9. The driving arrangement according to claim 7, further comprising a means for detecting a failure, wherein said balancing transformer further comprises a third winding magnetically coupled to the first winding and second winding of said balancing transformer, said means for detecting a failure circuit coupled to the third winding of said balancing transformer and arranged to detect one of an open circuit and a short circuit in one of said first, second and third LED strings.

10. The driving arrangement according to claim 9, wherein said means for detecting a failure comprises a means for sensing a current, and wherein said detection of one of an open circuit and a short circuit is responsive to said means for sensing a current sensing a current greater than a predetermined value.

11. The driving arrangement according to claim 7, further comprising:

a first end of the second winding of said balancing transformer is further coupled to the first end of the second winding of said driving transformer;

a second end of the second winding of said balancing transformer is coupled to the second end of the second winding of said driving transformer; and said third LED string is coupled between a center tap of said second winding of said balancing transformer and a center tap of said second winding of said driving transformer.

12. The driving arrangement according to claim 11, wherein said coupling between the first end of said second winding of said driving transformer and the first end of the second winding of said balancing transformer is via a respective unidirectional electronic valve; and said coupling between the second end of said second winding of said driving transformer and the second end of the second winding of said balancing transformer is via a respective unidirectional electronic valve.

* * * * *